United States Patent [19]

Rodth

[11] 3,985,272

[45] Oct. 12, 1976

[54] GRAVITY CONTROLLED BEVERAGE DISPENSER

[75] Inventor: Joseph John Rodth, Barkhamsted, Conn.

[73] Assignee: The Coca-Cola Co., Atlanta, Ga.

[22] Filed: Jan. 15, 1975

[21] Appl. No.: 541,167

[52] U.S. Cl. ..... 222/205; 259/96

[51] Int. Cl.[2] ..... B67D 5/06

[58] Field of Search ..... 222/129, 129.1, 133, 222/145, 205, 318, 333–335, 372, 373, 382, 383, 405, 410, 414, 424.5, 443, 464; 259/95, 96; 239/23; 99/275

[56] References Cited

UNITED STATES PATENTS

| | | | |
|---|---|---|---|
| 1,808,117 | 6/1931 | McLellan | 222/205 |
| 1,881,100 | 10/1932 | Smith | 222/205 |
| 1,930,293 | 10/1933 | Valentine | 222/318 |
| 1,930,294 | 10/1933 | Valentine | 222/318 |
| 2,460,757 | 2/1949 | Kurz | 259/96 |
| 3,123,255 | 3/1964 | Martin | 222/145 |
| 3,225,965 | 12/1965 | Jacobs et al. | 222/129.1 |
| 3,806,004 | 4/1974 | Kolkovsky | 259/96 |

*Primary Examiner*—Robert B. Reeves
*Assistant Examiner*—H. Grant Skaggs
*Attorney, Agent, or Firm*—W. Dexter Brooks

[57] ABSTRACT

A gravity feed controlled beverage dispenser is described wherein an improved electric motor operated pump is employed in cooperation with a storage container so as to thoroughly mix without causing foam and aeration of a dispensable fluid which is positioned within the container and lift the dispensable fluid from the container to a predetermined level in a cavity located in the upper part of the pump, and maintain it there to provide a constant level for accurate gravity feed control of the dispensable fluid from the container to a dispensing nozzle where it is discharged through the dispensing nozzle along with another fluid in a blended beverage mixture of pre-selected portions. One of the features of the beverage dispenser is the ease and accessibility of major components, including the pump, to be hand removed for efficient servicing and cleaning. The beverage dispenser is low in cost and of simple, reliable construction.

9 Claims, 4 Drawing Figures

GRAVITY CONTROLLED BEVERAGE DISPENSER

BACKGROUND OF THE INVENTION

The present invention relates to a gravity feed control beverage dispenser wherein an improved electric motor pump is employed within the dispenser in conjunction with a storage container to thoroughly mix without causing foam and aeration of a dispensable fluid which is positioned within the container and lift the dispensable fluid from the container to a pre-determined level in a cavity located in the upper part of the pump, and maintain it there to provide a constant level for accurate gravity feed control of the dispensable fluid from the container to a dispensing nozzle where it is discharged through the dispensing nozzle along with another fluid in a blended beverage mixture of preselected proportions. The dispenser is designed so that the major components, including the pump, are hand removable for efficient servicing and cleaning. The present invention avoids the relatively high investment cost of conventional beverage dispensers that normally transfer the dispensable fluid from a storage chamber to the dispensing nozzle by a sophisticated pumping arrangement such as a positive displacement pump or a float actuated liquid level control device. Moreover, the improved pump of the present invention is much more reliable than the so-called "chicken-feeder" or float controlled liquid level techniques employed in conventional dispensers. In the present invention, different types of apparatus and controls are uniquely combined in a compact cabinet to produce an accurate flow of hot water and liquid concentrate into a predetermined uniformly proportioned beverage. The electric motor operated pump is suspended from the storage container lid in order to allow these components to be easily removed and serviced. In addition to the pump lifting the dispensable fluid from the container to a predetermined level in a cavity located in the upper part of the pump, the pump embodies a unique impeller arrangement at the lower part of the pump for thoroughly agitating the dispensable fluid in the container.

In reviewing the prior art, it would appear that there are presently available a wide variety of dispensing devices that include a pumping arrangement for supplying a dispensable fluid from a storage container to a dispensing nozzle.

There are presently available a wide variety of dispensing devices that include an agitator assembly for mixing a dispensable liquid within a storage container. However, these dispensers also have not been found totally acceptable since they fail to alleviate the problems encountered in dispensing those liquids that contain soluble solids, such as fresh fruit juices, coffee, tea, or syrup, which, of necessity, must be kept cold to a certain extent to be palatable. This normally has been done by the use of a refrigerating element which is placed in close proximity to the dispenser in order to maintain or provide a cold environment for the concentrate. Further, in order to prevent the constituents of the concentrate from settling on the bottom of the dispenser container, or stratifying therein, revolving paddles or circulating pumps have been employed in the container for agitating the concentrate. This form of agitation has been used in the beverage industry, but frequently not found totally acceptable since 'dead spots' will occur in the region of the dispensing tap and on the bottom of the container. The liquid trapped in these 'dead spots' not only becomes unpalatable, but tends to spoil more quickly than the cooler, thoroughly mixed liquid and causes deposits of scum or sediment to form within the container. Also, the circulation is inadequate next to the wall of the container, giving rise to a ring of scum thereon which is unsightly, hard to remove and difficult to sterilize. Because of and to try to overcome these problems, the agitator assemblies normally have been operated continuously.

Accordingly, there has arisen a need in the industry for a reliable beverage dispenser apparatus, preferably of simple construction, wherein a dispensable fluid may be supplied from a storage container of the dispenser to a dispensing nozzle under a wide range of viscosity changes by accurate gravity feed control, while, at the same time, providing an arrangement such that the dispensable fluid in the container may be subjected to a uniform, complete and thorough agitation, and further allow the thoroughly agitated dispensable fluid to be brought together with a second dispensable fluid at the dispensing nozzle in a fashion such as to create a visual flow of the mixed fluids when they are dispensed.

OBJECTS OF INVENTION

It is, accordingly, the object of the present invention to provide an improved beverage dispenser.

Another object of the present invention is to provide an improved gravity feed controlled beverage dispenser incorporating an electric motor operated pump, generally of the type described, which is low in cost and of simple, reliable construction.

Another object of the present invention is to provide a beverage dispenser, the major components of which may be easily disassembled and cleaned in order to meet sanitary requirements or purposes.

A further object of the present invention is to provide a beverage dispenser which embodies an improved agitator mechanism.

Another object of the present invention is to provide an improved beverage dispenser having an electric motor operated pump which functions within a storage container so as to thoroughly mix and lift a dispensable fluid from the container to a predetermined level in a cavity located in the upper part of the pump.

It is another feature of the present invention to provide a beverage dispenser with a pumping arrangement such that a constant level of dispensable fluid is maintained at the upper portion of the pump for accurate gravity feed control of the agitated dispensable fluid when it is transferred from the container to a dispensing nozzle during operation of the dispenser.

A still further object of the present invention is to provide an improved beverage dispenser of rugged, compact construction having a minimum number of moving parts which exhibits significantly improved operating capabilities in positively dispensing different fluids. These, other, and further objects, important features, and advantages of the present invention to which attention has not been specifically directed herein, will be better understood and appreciated from those skilled in the art from the following detailed description, taken in conjunction with the accompanying drawings.

BRIEF DESCRIPTION OF THE DRAWINGS

The present invention will now be described by way of example, with reference to the accompanying drawings.

DETAILED DESCRIPTION OF INVENTION

Figure 1:
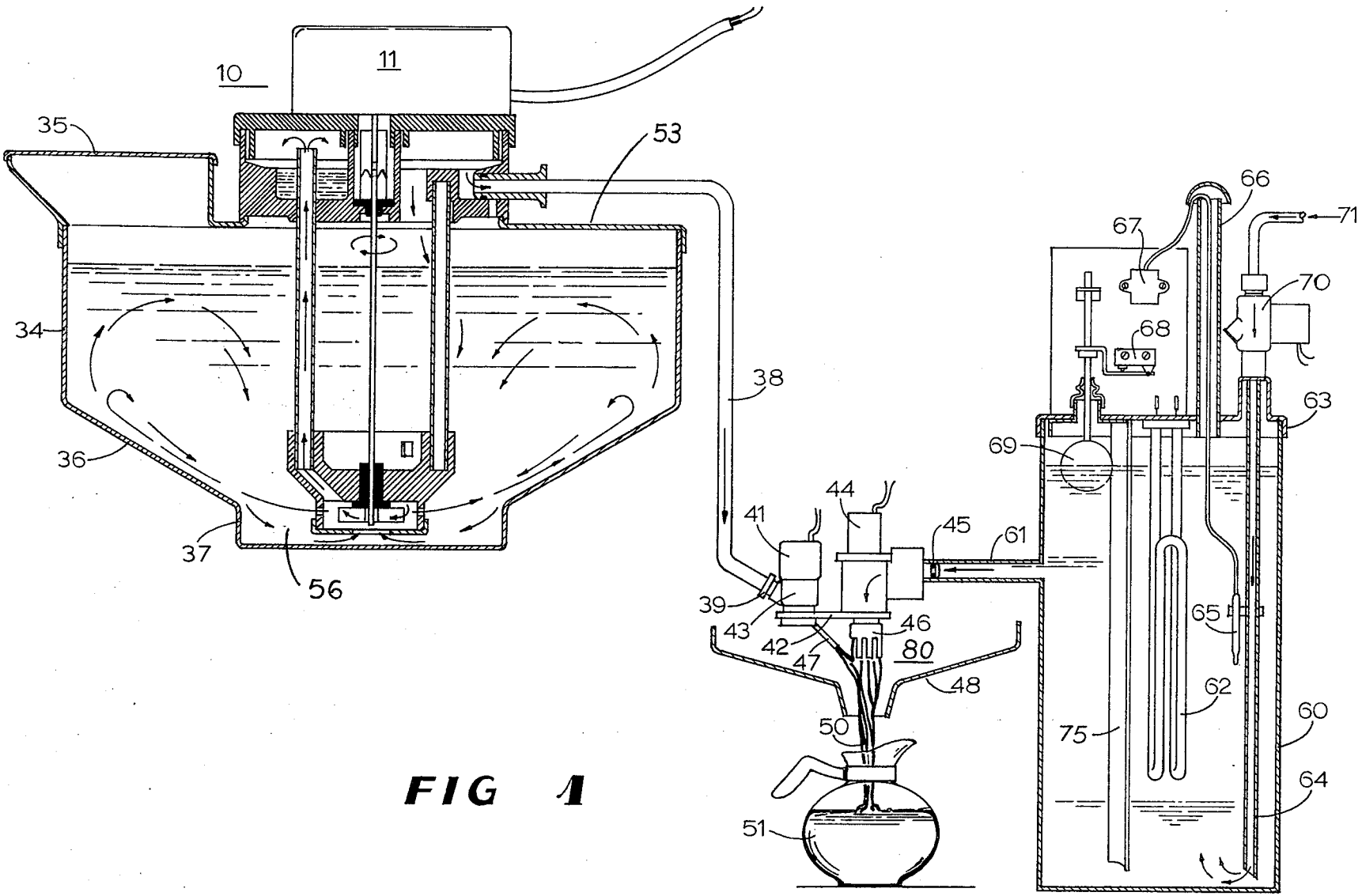
FIG. 1 is a side elevational view, partly in section, showing a beverage dispenser embodying the novel features of the present invention.
Figure 4:
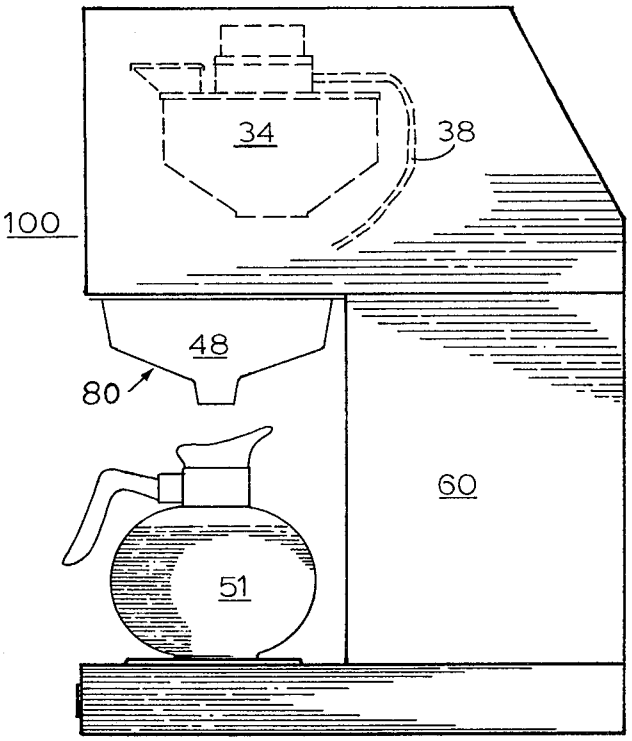
FIG. 4 is a side view of the beverage dispenser of the present invention wherein certain of the major components are illustrated in their operative assembled position within a cabinet.
Figure 2:
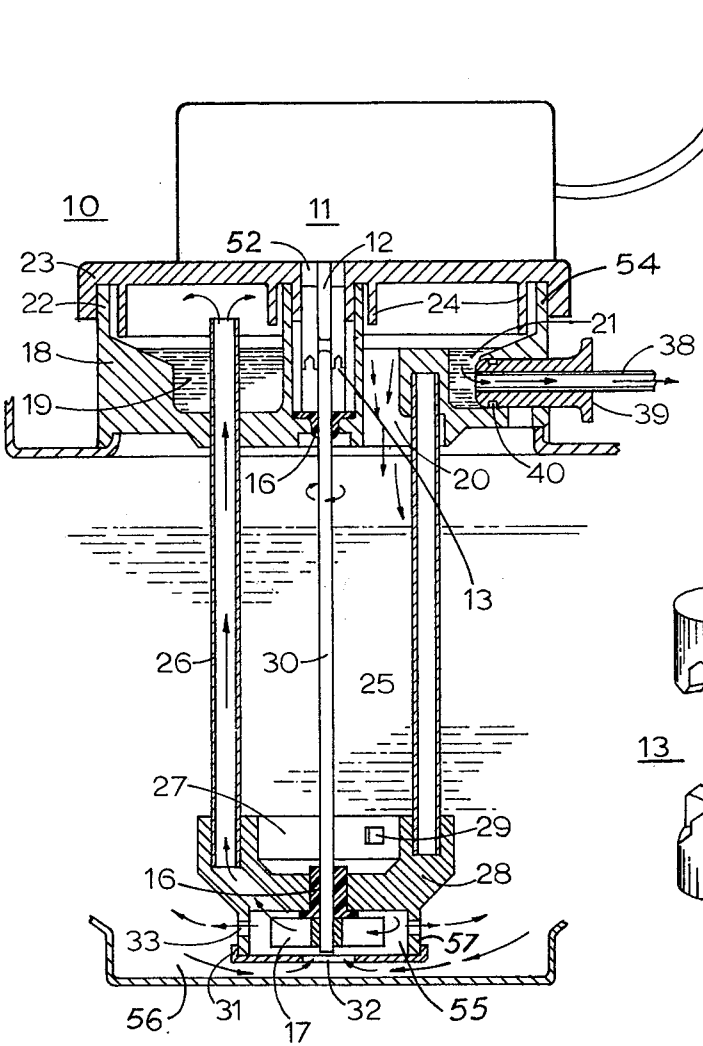
FIG. 2 is a side elevational view, partly in section, showing in more detail the novel features of the electric motor operated pump 10 of FIG. 1.

Referring to the drawings in detail wherein one embodiment of a dispenser incorporating this invention is shown in FIGS. 1 and 2, it will be understood that a cabinet 100 such as illustrated in FIG. 4 may be provided for supporting and enclosing various operating components (schematically illustrated in FIGS. 1 and 2) in their operative, assembled relationship. While the dispenser is capable of quickly and positively discharging fluids of various types in different applications, it is particularly suited for dispensing both hot and cold liquid beverages. The term beverage as referred to herein will be understood to include a variety of consumable liquids, such as coffee, soup, beer, fruit juices, vegetable juice, milk, tea and similar liquid foods and drinks. Separate metered quantities of either hot or cold liquids may be dispensed through the dispensing nozzle of the dispenser, but for purposes of illustration, the embodiment shown in FIGS. 1 and 2 will be described in connection with the control dispensing of separate portions of hot water and concentrate or syrup (cold or at room temperature) to provide a blended hot beverage.

To effect precision metering and simultaneous discharge of water and beverage concentrate in precisely proportioned quantities for a single serving, an electric motor operated pump assembly 10 is provided in accordance with this invention as best seen in FIG. 2. The pump 10 is shown as being supported in a suspended fashion from a storage container lid 53 which is removably secured to and over the top opening of the concentrate storage container 34. The pump 10 is provided with an upper reservoir housing 18 and a lower impeller housing 28, which are positioned in a spaced relationship along the same longitudinal axis, which axis is defined by an impeller shaft member 30 which, as shown in FIG. 2, extends between the upper reservoir housing 18 and the lower impeller housing 28. The upper housing 18 and lower housing 28 are formed of any suitable wear resistant plastic material. The impeller shaft member 30 is made of any corrosion resistant material, such as stainless steel. At least one support column 25 is employed between the upper reservoir housing 18 and lower impeller housing 28 for supporting the upper and lower housings 18 and 28 in spaced relationship. The support column 25 is made of any suitable material of sufficient strength to support the respective housings 18 and 28 in relation to one another and may be either solid or tubular in construction. In the preferred embodiment, a pair of support columns 25 and 26 are depicted. One of the columns 26, as illustrated in FIG. 2, functions not only as a support column, but also as a riser tube or conduit for the liquid concentrate as described below. The upper housing 18 and lower housing 28 may be constructed of any suitable configuration, but, in the preferred embodiment of the present invention, are provided as circular members. The upper reservoir housing 18 is provided with an outer peripheral wall 54, which tapers down to an upper reservoir cavity 19, of a predetermined capacity, in which liquid driven up the riser tube 26 is collected. The upper reservoir housing 18 is provided with at least one overflow aperture 20, located near but not within the upper reservoir cavity 19, to allow an excess of liquid in the upper reservoir cavity 19 to be returned to the concentrate container 34. This arrangement allows a constant pressure head for gravity feed of the liquid concentrate from the upper reservoir cavity 19 to be effected. The overflow aperture 20 is provided in the upper reservoir housing 18 in a position clearly adjacent to and directly above the support column 25 so that the excess liquid is returned to the storage container 34. The liquid is caused to impinge upon the support column 25 due to its capillary attraction thereto, and thus flows down the support column 25 to fill an air seal cavity 27, centrally located in the upper surface of the lower impeller housing 28. The air sealed cavity 27 is positioned in a fashion on the lower impeller housing 28 so that the cavity is filled with a liquid regardless of the level of the liquid concentrate within the storage container 34. By being filled with liquid, the air sealed cavity 27 prevents the intake of air through the sleeve bearing 16 to the pump impeller during operation of the pump. In the absence of such a cavity 27, the air would cause foaming within the impeller cavity 55. The lower impeller housing 28 is provided with a lower impeller cavity 55, which is defined by an outer peripheral rim portion 57. The outer rim portion 57 has a series of sidewall apertures 33 which allow the liquid concentrate to partially escape at a high velocity from the impeller cavity 55 during operation of the pump 10. The upper reservoir housing 18 is provided with a lid member 23 as shown in FIG. 2. The lid 23 is provided with a series of concentric barriers 24 to preclude the liquid from escaping from the upper reservoir housing 18. A centrally located opening is provided in the lid 23, upper reservoir housing 18, lower impeller housing 28 and cap member 31 so that a pump impeller shaft 30 may centrally extend between all of these members and support the same in a coaxial alignment. The pump impeller shaft 30 extends between a pair of sleeve bearings 16. One sleeve bearing 16 is rigidly located in the center of the upper reservoir housing, and the other sleeve bearing 16 is rigidly located in the center of the lower impeller housing 28. These sleeve bearings 16 may be made of any well-known wear resistant plastic material, such as Rulon or Teflon, and act as a guide for the pump impeller shaft 30 when it is rotated by the motor 11.

Figure 3:
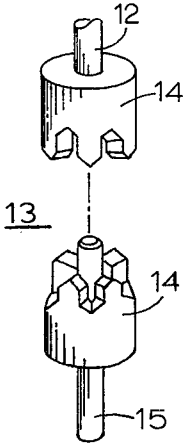
FIG. 3 is an exploded view of the coupling 13 between the electric motor 11 and pump 10 as illustrated in FIG. 2.

The motor 11 includes a shaft member 12, which is inserted into the upper reservoir housing 18 through the opening 52 in lid 23 for coupling engagement with the pump impeller shaft 30. A coupling 13, as more precisely illustrated in FIG. 3, is provided for reliable coupling of the two shaft members 12 and 15. The shaft members 12 and 15 are provided with serrated gear portions 14, which are formed of a hard nylon or rubber material, and are adapted for meshing together into a flexible coupling assembly. The shaft member 15, of course, is a continuation of the pump impeller shaft 30. At a lower position of the pump impeller shaft 30, an impeller 17 is securely attached. The impeller 17 is provided with a plurality of extending rib members such that upon rotation thereof, a thorough radial agitation of liquid within the lower impeller cavity 55 ensues, as will be more aptly described below.

The upper reservoir housing 18 is also provided with an outlet aperture 21 in the upper reservoir cavity 19. The outlet aperture 21 is provided between the upper reservoir cavity 19 and the exterior of the upper reservoir housing 18, such that a flexible tubing may be connected thereto for reliable and efficient transfer of the liquid concentrate from the upper reservoir cavity 19 to the dispensing nozzle 47.

Dealing with the concentrate storage container 34, as shown in FIG. 1, the container 34 is generally of a cylindrical configuration the bottom surface 36 of which is gradually tapered inwardly and downwardly to a shallow cylindrical well 56 at the extreme bottom of the container 34. The bottom surface 36 is provided with an offset shoulder 37, the upper portion of which is located at a point slightly lower than the side wall apertures 33 of the lower impeller housing 28. The upper surface of container 34 is provided with a funnel opening 35 for the supply of new liquid concentrate to the container.

Turning now to the other major components in the dispenser of the present invention, it will be seen in FIG. 1 that a flexible tubing 38 is extended between the outlet aperture 21 of the upper reservoir cavity 19 of the pump 10 to the dispensing valve 43, which is supported on a bracket 42 at the dispensing nozzle assembly 80. The flexible tubing 38 is provided at both ends with self-sealing plugs 39, respectively, one plug being forcibly inserted into the outlet aperture 21 of upper reservoir housing 18, and the other plug being inserted into the inlet aperture of the solenoid operated valve member 43.

Dealing with the hot water dispensing assembly, it will be seen in FIG. 1 that a hot water tank 60 is provided with a plurality of conventional elements in a compact cabinet. The hot water tank 60 is provided with an upper cover 63, in which a float assembly 69, baffle 75, heating element 62, and water fill tube 64 are suspended into water which is contained and heated in the hot water tank 60. An electrically operated thermostat 67, including a sensing bulb 65, is provided in conjunction with the hot water tank 60 for controlling the water temperature within the water tank 60. A water fill valve 70 is provided outside the water tank 60 at the upper portion of the water fill tube for controlling water from a water source 71 into the hot water tank 60. A tubular extension 61 is provided in the sidewall of the hot water tank 60 for supply of hot water to the dispensing nozzle assembly 80. A solenoid operated water valve 44 is connected to the tubular extension 61 for controlling water flow through a spoiler 46 of the dispensing nozzle assembly 80. A dispensing nozzle cover 48 is provided over the dispensing nozzle assembly 80 for aesthetic and sanitary purposes.

While not described in detail, suitable fluid-tight seals and packing rings are provided throughout the dispenser where needed to ensure against undesired fluid leakage, in accordance with well known conventional techniques. Each of the seals is preferably formed of a suitable, commercially available, dry bearing plastic material exhibiting low abrasive characteristics and minimal deformation under load while possessing high wear resistance and high compression strength over a wide range of temperature to provide a suitable low friction piston seal.

Referring to FIG. 4, for illustrative purposes the major components are depicted in operative, assembled relationship within a cabinet 100. The concentrate storage container 34, including the pump 10, is located in the upper portion of the cabinet 100, while the hot water tank 60 is positioned in a separate compartment below and to the rear of the concentrate storage container 34. The dispensing nozzle 48 assembly 80 with cover is illustrated as being positioned directly below the concentrate storage container 34 and in close proximity to the hot water tank 60 for dispensing a beverage of blended proportions into a carafe 51.

To operate the dispenser, an operation button (not shown) is provided on the cabinet 100 and upon actuation thereof, the solenoids 41 and 44 and motor 11 are energized. Upon such actuation, the motor operates the impeller 17 and causes liquid concentrate to be sucked up into the bottom of the impeller cavity 55 through the opening 32 in cap member 31. The impeller 17 creates a centrifugal action which causes liquid concentrate to be expelled out through the series of outer sidewall apertures 33 of the lower impeller housing 38 and agitate the liquid concentrate located outside the lower impeller housing 28. Simultaneously, the impeller action drives the liquid concentrate up the riser tube 26 to fill the upper reservoir cavity 19 of the upper reservoir housing 18. It should be noted that the volume of the liquid concentrate that is forced up the riser tube 26 is clearly in excess of the liquid concentrate drawn from the upper reservoir cavity 19 for dispensing purposes. The purpose of this action is to replenish and agitate the liquid concentrate in the upper reservoir cavity 19. Thus, the overflow aperture 20 is provided, as discussed above, to allow the excess liquid concentrate to return to the concentrate container 34. The upper reservoir cavity 19 is designed in a predetermined manner so that the liquid concentrate therein may be controlled or maintained at a constant level. Needless to say, the liquid concentrate level in the cavity 19 of upper reservoir housing 18 and the elevated location thereof cooperate together to provide a constant fixed pressure head to control the gravity feed of liquid concentrate from the outlet aperture 21 and through the flexible tubing 38 to the dispensing valve 43 of nozzle assembly 80.

The dispensing valve 43 is provided with a knife edge orifice in a thin metal disc (not shown) for regulating the flow of liquid concentrate from the dispensing tube 47. The thin metal disc is replaceable, and the flow of the liquid concentrate is controlled by the diameter of the knife edge orifice. Needless to say, the knife edge orifice in the metal disc must be smaller than any other diameter in the liquid concentrate outlet circuit between the upper reservoir cavity 19 and the dispensing tube 47 to ensure the controlled flow of the liquid concentrate.

During the dispensing operation, the hot water valve 44 opens and allows hot water to flow from the hot water tank 60. The float assembly 69 of the hot water assembly is of a conventional nature. As the water level in the tank is lowered, the float assembly 69 drops, causing the Micro-switch 68 to be closed, thus energizing the water fill valve 70, thus maintaining the level of the hot water in the tank 60 above the water valve 44 to control the uniform flow of hot water from the tank 60. The thermostat 67 is used to control the heating element 62 in a conventional manner to control the temperature of the water.

In view of the above-described embodiments it will be seen that a dispenser can be readily constructed in accordance with this invention for dispensing metered quantities of a plurality of different fluids each of which can be either hot or cold, depending on the requirements of the beverage desired to be dispensed. The beverage dispenser of this invention will be seen to be of rugged, compact construction which is quick and easy to assemble, in addition to being capable of providing high speed, dependable operation over extended periods of time with minimal maintenance and service requirements.

As will be apparent to persons skilled in the art, various modifications, adaptations and variations of the foregoing specific disclosure can be made without departing from the teachings of the present invention.

It should be manifest that while a preferred embodiment of the present invention has been shown and described for illustrative purposes, the present invention is nevertheless capable of wide variation within the purview of the invention. For example, the present invention could be modified and incorporated in a conventional postmix carbonated beverage system, and such a modification would involve the replacement of the hot water tank 60 with a pressurized carbonated water tank of conventional construction.

The embodiments of the invention in which an exclusive property right or privilege is claimed are defined as follows:

1. A beverage dispenser having a container for holding an additive fluid to be dispensed wherein pumping means comprising an upper housing and a lower housing are provided within the container for agitating a dispensable additive fluid and lifting the dispensable fluid to an elevated position within the container, and wherein the pumping means are provided with an upper reservoir cavity for receiving the dispensable additive fluid at said elevated position, said upper housing and lower housing being held in spaced relationship by at least one support column, and wherein said upper reservoir cavity is formed integrally with (provided in) the top surface of the upper housing, said upper housing comprising a plate having an outer peripheral wall that tapers down to said upper reservoir cavity, and further wherein the upper reservoir cavity is provided with an outlet aperture for controlled gravity feed of the dispensable additive fluid in an accurately metered proportional flow from the upper reservoir cavity to a dispensing nozzle located below.

2. A beverage dispenser as defined in claim 1, wherein: the pumping means includes conduit means for conveying the dispensable additive fluid from the lower housing to the upper reservoir cavity in the top surface of the upper housing.

3. A beverage dispenser as defined in claim 1, wherein: the upper housing and lower housing are provided respectively with a center hole and are positioned in a spaced relationship along the same longitudinal axis, which axis is defined by an impeller shaft member that is extended between the center holes of said upper housing and lower housing, and wherein the bottom end of said impeller shaft member is provided with an impeller element positioned below the lower housing and the top end of the impeller shaft member is provided with a coupling means for meshing together with a similar coupling means of an impeller drive means located outside the container.

4. A beverage dispenser as defined in claim 3, wherein: conduit means are provided between the lower housing and upper housing for conveying the dispensable additive fluid from below the lower housing to the upper reservoir cavity in the top surface of the upper housing, and further wherein said upper housing is provided with an outer peripheral wall that tapers down to said upper reservoir cavity in which the dispensable additive fluid driven up the conduit means is collected, and wherein said lower housing is provided with an outer peripheral rim portion on the bottom which defines a lower impeller cavity in which said impeller element is rotated during its operation, and further wherein said outer peripheral rim portion is provided with a series of sidewall apertures, whereby the dispensable additive fluid is allowed to partially escape out the sidewall apertures at a high velocity from the impeller cavity during operation of the pump.

5. A beverage dispenser as defined in claim 4, wherein: the container for holding the additive fluid is provided with a lid member having a centrally located opening, and wherein the upper housing is provided with a lid member having a centrally located opening, and wherein the lower housing is provided with a cap member having a centrally located opening, all of said opening being in coaxial alignment, and wherein the centrally located opening in the lid, upper housing and lower housing are adapted to receive said impeller shaft member, and wherein said cap member opening is adapted upon impeller action to suck up into the bottom of the impeller cavity the agitated dispensable fluid, whereupon said fluid is subjected to centrifugal action by the impeller element and a portion expelled out through the series of outer sidewall apertures of the lower housing and agitate the dispensable fluid located outside the lower housing while at the same time a substantially greater portion is forced up the conduit means to fill the upper reservoir cavity.

6. A beverage dispenser as defined in claim 5, wherein: the upper housing is provided with at least one overflow aperture which extends from the top surface to the bottom surface of the upper housing to allow excess of dispensable additive fluid in the upper reservoir cavity to be returned to the container and thus, allow a constant pressure head for gravity feed of the dispensable additive from the upper reservoir cavity to be effected.

7. A beverage dispenser as defined in claim 6, wherein: the at least one aperture is located adjacent to the upper reservoir cavity and directly above the at least one support column so that excess liquid is caused to impinge upon the at least one support column due to its capillary attraction and flow down the at least one support column to fill an air seal cavity which is provided in the top surface of the lower housing, whereby the intake of air through the opening in the lower housing is prevented during operation of the impeller element.

8. A beverage dispenser as defined in claim 1, wherein said at least one support column comprises a riser tube for conveying the dispensable additive fluid from the lower housing to the upper reservoir cavity in the top surface of the upper housing.

9. A beverage dispenser having a container for holding an additive fluid to be dispensed wherein:

pumping means are provided within the container for agitating a dispensable additive fluid and lifting the dispensable additive fluid to an elevated position, and wherein the pumping means comprises an upper housing and a lower housing, said upper housing having an outer peripheral wall that tapers down to an upper reservoir cavity which is provided on the top surface of the upper housing, said upper reservoir cavity having an outlet aperture for controlled gravity feed of the dispensable additive fluid in an accurately metered proportional flow from the upper reservoir cavity to a dispensing nozzle located outside the container and below the upper reservoir cavity, and wherein said lower housing is provided with an outer peripheral rim portion on the bottom which defines a lower impeller cavity, and conduit means being extended between the impeller cavity and the upper reservoir cavity, said upper housing and lower housing having a centrally located opening therein and being positioned in a spaced relationship along the same longitudinal axis, which axis is defined by an impeller shaft member that is extended through such openings between said upper and lower housings, and wherein the bottom end of said impeller shaft is provided with an impeller element positioned below the lower housing in said impeller cavity and the top end of the impeller shaft member is provided with a coupling means for meshing together with a similar coupling means of an impeller drive means located outside the container, and further wherein upon impeller action, the dispensable additive fluid is subjected to centrifugal action by the impeller element creating thorough agitation of the dispensable additive fluid, while at the same time driving a greater portion of the dispensable additive fluid up the conduit means to fill the upper reservoir cavity, said driven dispensable additive fluid replenishing and agitating the dispensable additive fluid contained in the upper reservoir cavity, and wherein at least one overflow aperture is provided in the upper housing to allow excess of dispensable additive fluid in the upper reservoir cavity to be returned to the container and thus, allow a constant pressure head for gravity feed of the dispensable additive fluid from the upper reservoir cavity to be effected.

* * * * *